US011946222B2

(12) United States Patent
Unnebäck et al.

(10) Patent No.: US 11,946,222 B2
(45) Date of Patent: Apr. 2, 2024

(54) WORKING MACHINE

(71) Applicant: VOLVO CONSTRUCTION EQUIPMENT AB, Eskilstuna (SE)

(72) Inventors: Joakim Unnebäck, Eskilstuna (SE); Andrew Woodman, Randbol (DK)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 579 days.

(21) Appl. No.: 16/973,911

(22) PCT Filed: Jun. 12, 2018

(86) PCT No.: PCT/EP2018/065524
§ 371 (c)(1),
(2) Date: Dec. 10, 2020

(87) PCT Pub. No.: WO2019/238221
PCT Pub. Date: Dec. 19, 2019

(65) Prior Publication Data

US 2021/0270010 A1 Sep. 2, 2021

(51) Int. Cl.
*E02F 9/08* (2006.01)
*E02F 9/18* (2006.01)

(52) U.S. Cl.
CPC ..... *E02F 9/0841* (2013.01); *E02F 9/18* (2013.01)

(58) Field of Classification Search
CPC ... E02F 9/0841; E02F 9/18; B60P 1/48; B60P 1/483; B60P 1/50; B60P 1/54;
(Continued)

(56) References Cited

U.S. PATENT DOCUMENTS 2,967,718 A * 1/1961 Orwig ..... B62D 49/085 280/515
3,342,357 A * 9/1967 Larson ..... A01G 23/006 414/731

(Continued)

FOREIGN PATENT DOCUMENTS

CH 697556 11/2008
CN 101248325 A 8/2008

(Continued)

OTHER PUBLICATIONS

Office Action, Korean Patent Application No. 10-2021-7000824 dated Aug. 25, 2022, 12 pages.

(Continued)

*Primary Examiner* — Glenn F Myers
(74) *Attorney, Agent, or Firm* — Sage Patent Group

(57) ABSTRACT

The present invention relates to a working machine, including a pair of front wheels having a front rotational axis, a pair of rear wheels having a rear rotational axis, a frame structure including a front frame portion connected to the front rotational axis, a rear frame portion connected to the rear rotational axis, and a pivot joint pivotally connecting the front and rear frame portions to each other around a laterally extending pivot axis, an actuator arrangement connected to the frame structure, the actuator arrangement being arranged to control a mutual motion between the front frame portion and the rear frame portion; and a lift arm including an inner end portion pivotably connected to the front frame portion at a position between the front and rear wheels.

14 Claims, 4 Drawing Sheets

(58) Field of Classification Search
CPC ..... B60P 1/5428; B60P 1/5423; B60P 1/5438; B60P 1/5457; B60P 1/5461; B60P 1/5485; B60P 1/549; B62B 3/008; B62B 3/08; B62B 3/02; B62B 3/10; B62B 3/104; B62B 2203/11; B62B 2203/10; B62B 2203/07; B62B 2205/06; B62B 2207/00; B62B 5/0083; B62B 1/264; B66C 2700/0392
See application file for complete search history.

(56) References Cited

U.S. PATENT DOCUMENTS

| | | | | |
|---|---|---|---|---|
| 3,904,054 | A * | 9/1975 | van der Lely | B60P 1/483 280/764.1 |
| 4,318,664 | A * | 3/1982 | Gibert | E02F 9/0808 180/209 |
| 4,417,841 | A | 11/1983 | Chadwick | |
| 4,848,012 | A | 7/1989 | Zimmerman | |
| 6,846,152 | B2 | 1/2005 | Mikrut et al. | |
| 2015/0123059 | A1* | 5/2015 | West | B62B 3/0612 254/9 R |
| 2018/0316895 | A1* | 11/2018 | McClelland | G07C 5/02 |

FOREIGN PATENT DOCUMENTS

| | | | |
|---|---|---|---|
| CN | 202030331 | U | 11/2011 |
| DE | 2454021 | A1 | 5/1976 |
| EP | 0012095 | A1 | 6/1980 |
| EP | 0628664 | A2 | 12/1994 |
| GB | 1233622 | A | 5/1971 |
| JP | 46-038306 | | 11/1971 |
| JP | S55-500507 | A | 8/1980 |
| JP | 61-150208 | | 9/1986 |
| JP | H01125276 | | 8/1989 |
| JP | 2000-001295 | | 1/2000 |
| JP | 2004-183475 | A | 7/2004 |
| JP | 2013-006457 | | 1/2013 |
| JP | 2019-058154 | | 4/2019 |
| KR | 20110067456 | A | 6/2011 |
| WO | WO 79/00651 | | 9/1979 |
| WO | WO 2007/020276 | A2 | 2/2007 |

OTHER PUBLICATIONS

International Search Report and Written Opinion of the International Searching Authority, PCT/EP2018/065524, dated Feb. 12, 2019, 11 pages.
First Office Action, Chinese Patent Application No. 201880094376.X, dated Dec. 31, 2021, 22 pages.
First Office Action, Japanese Patent Application No. 2020-569910, dated Mar. 15, 2022, 10 pages.

* cited by examiner

WORKING MACHINE

CROSS REFERENCE TO RELATED APPLICATIONS

This application is a 35 U.S.C. § 371 national stage application of PCT International Application No. PCT/EP2018/065524 filed on Jun. 12, 2018, the disclosure and content of which is incorporated by reference herein in its entirety.

TECHNICAL FIELD

The present invention relates to a working machine. The invention also relates to method for operating such a working machine.

BACKGROUND

Within the field of working machines, the development is continuously increasing to meet the various demands from the market. For example, the working machines are operated with smart control functions for improving operations at the work site. In particular, the working machines may communicate with each other for optimizing operation at the work site.

As the working machines communicate with each other, either directly (V2V communication) or indirectly via a control station, it is possible to be able to operate the working machines autonomously, i.e. without the use of an operator occupying a cabin in the working machine. In comparison to a conventional working machine, the autonomously controlled working machine is thus not in need of a cabin compartment as there is no operator physically positioned on the machine for controlling the working machine. The cabin compartment is thus more or less superfluous.

The removal of the cabin compartment will enable for a working machine which is smaller in size and/or which may utilize the area of the normally arranged cabin compartment for other purposes. Thus, in addition to be able to control the working machine autonomously, there is a desire to be able to improve various operational control functions of the working machine for improving the operation of the working machine.

SUMMARY

It is thus an object of the present invention to provide a working machine which is able to improve at least some of its working operations. This is achieved by a working machine according to claim 1.

According to a first aspect, there is provided a working machine, comprising a pair of front wheels having a front rotational axis, a pair of rear wheels having a rear rotational axis, a frame structure comprising a front frame portion connected to the front rotational axis, a rear frame portion connected to the rear rotational axis, and a pivot joint pivotally connecting the front and rear frame portions to each other around a laterally extending pivot axis, an actuator arrangement connected to the frame structure, the actuator arrangement being arranged to control a mutual motion between the front frame portion and the rear frame portion; and a lift arm comprising an inner end portion pivotably connected to the front frame portion at a position between the front and rear wheels, and an outer end portion connectable to an implement at a position in front of the pair of front wheels as seen in the longitudinal direction of the working machine.

The wording "front and rear rotational axis" should be construed as relating to either a wheel axle, or to a pair of rotational axes. In the latter case, the working machine may be provided with wheel hub motors on e.g. the respective left and right front wheels. In such case, the left and right front wheels are not connected to each other by a conventional wheel axle. Thus, the front wheels have in such a case a geometric axis around which the wheels rotate. The same applies for the rear wheels. Also, the wording "front" and "rear" should be understood to relate relative measures as seen in the forward driving direction of the working machine. Other alternatives are also conceivable such as an electric motor connected to one or more of the wheel axles, etc.

Furthermore, the wordings "front frame portion" and "rear frame portion" should be construed such that at least a portion of the front frame portion is arranged in front of the rear frame portion as seen in relation to the forward driving direction of the working machine. Thus, and as will be described further below, the front frame portion may have a portion which is located rearwards of the rear frame portion.

Still further, the actuator arrangement may comprise any suitable actuator for controlling the mutual motion between the front and rear frame portions. The actuator arrangement may, for example, be of a hydraulic, pneumatic or electric type. For example, and as will be described below, the actuator arrangement may be a hydraulic cylinder which is arranged between portions of the front and rear frame portions.

The actuator arrangement and the lift arm may preferably be controlled by means of receiving respective signals from a control unit. The control unit may thus transmit a control signal to the control functions of the actuator arrangement in order to achieve the mutual motion. Also, the control unit may also transmit a control signal to an actuator which is arranged to control the pivotal motion of the lift arm. Separate control units may also be provided for controlling the different functionalities, i.e. the mutual motion of the front and rear frame portions and the pivotal motion of the lift arm.

The control unit may include a microprocessor, microcontroller, programmable digital signal processor or another programmable device. The control unit may also, or instead, include an application specific integrated circuit, a programmable gate array or programmable array logic, a programmable logic device, or a digital signal processor. Where the control unit includes a programmable device such as the microprocessor, microcontroller or programmable digital signal processor mentioned above, the processor may further include computer executable code that controls operation of the programmable device.

The inventors of the present disclosure have realized that by providing a working machine in which the front frame portion is movable in relation to the rear frame portion, the movement pattern of the lift arm may be significantly improved. In particular, depending on the rotational position of the lift arm at the inner end portion, the front frame portion can be moved away from the rear frame portion, or be arranged closer to the rear frame portion. Thus, displacing the front frame portion away from the rear frame portion results in that the inner end portion of the lift arm will be raised. According to an example as will also be described further below, during a digging event, the front frame portion may be displaced from the rear frame portion such that the inner end portion of the lift arm is arranged at a second, elevated position. Hereby, the outer end portion of the lift arm can be further lowered for being able to dig deeper into the pile of soil. Thereafter, when raising the outer end portion, the front frame portion is moved in a direction towards the rear frame portion for lowering the inner end portion of the lift arm to a first, lower position. Hereby, the movement of the outer end portion of the lift arm will be arranged at a longitudinally closer position relative to the front wheels in comparison to raising the outer end portion when the inner end portion is arranged at the second position. This will improve the stability during such lifting motion.

As will also be described further below, the working machine is preferably autonomous. Hereby, the working machine does preferably not contain a cabin compartment. The inner end portion of the lift arm is thus preferably positioned in an area which is normally occupied by such cabin compartment. An advantage is that the outer end portion of the lift arm can be arranged longitudinally closer to the front wheels. Hence, the entire lift arm can be arranged rearwards in comparison to a working machine comprising a cabin compartment. The load distribution from the lift arm and the weight of material at the outer end portion is hereby improved as the inner end portion of the lift arm is arranged closer to the rear wheels in comparison to a conventional working machine provided with a cabin compartment. Hence, a more equal load distribution for the front and rear wheels may be achieved.

According to an example embodiment, the actuator arrangement may be arranged to control the inner end portion of the lift arm between a first position and a second, vertically higher position when moving the front and the rear frame portions relative to each other.

As described above, the inner end portion is in the second position raised in relation to the first position. As the front frame portion is connected to the front rotational axis, the lift arm will move around the front rotational axis. Hereby, when lifting the rear end portion, the lift arm will rotate around the front rotational axis which will lower the front end portion of the lift arm.

Hence, according to an example embodiment, the outer end portion of the lift arm may be controllable between a vertical upper end position and a vertical lower end position by a pivotal motion of the inner end portion of the lift arm, the vertical lower end position being provided at a lower vertical distance from ground level when the inner end portion assumes the second position compared to when the inner end portion assumes the first position.

An advantage is, as described above, that an implement connected to the outer end portion of the lift arm is able to approach e.g. a pile of soil closer to ground level, thus improving the digging functionalities.

It should be readily understood that the second position may not necessarily be located straight above the first position. For example, the second position can also be arranged in front of the first position as seen in the longitudinal direction of the working machine.

According to an example embodiment, the front rotational axis and rear rotational axis may move toward each other by a rotation of the pivot joint when moving the inner end portion of the lift arm between the first and second positions.

According to an example embodiment, the front frame portion may be pivotably connected to the front rotational axis and the rear frame portion may be pivotably connected to the rear rotational axis. The pivotal connection enables for improved movement between the front and rear frame portions. Hence, when the inner end portion of the lift arm is raised from the first position to the second position, the front and rear wheels move towards each other whereby a front end of the front frame portion rotates around the front rotational axis, and a rear end of the rear rotational axis rotates around the rear rotational axis.

According to an example embodiment, the actuator arrangement may be an actuator cylinder arranged move at least portions of the front and rear frame portions away from each other when moving the inner end portion of the lift arm from the first position to the second position. The actuator cylinder is preferably hydraulically controlled, although pneumatics may function as well. The wording "away from each other" should be construed as being in at least a vertical direction of the working machine.

According to an example embodiment, at least a portion of the front frame portion may be arranged vertically above at least a portion of the rear frame portion. Hereby, the front frame portion extends from the front rotational axis and to a position rearward the pivotal connection between the front and rear frame portions.

According to an example embodiment, the actuator arrangement may be connected between the portion of the front frame portion and the portion of the rear frame portion. The actuator arrangement thus "pushes" the front frame portion in at least a vertical direction above the rear frame portion.

According to an example embodiment, the working machine may further comprise a counterweight arrangement connected to the front frame portion. A counterweight is beneficial as it will improve the stability of the working machine during its various operations.

According to an example embodiment, the front frame portion may extend from the front rotational axis and in a direction rearward of the front rotational axis, wherein the counterweight is movable along at least a portion of the extension of the front frame portion.

Hereby, the counterweight is operable to be control dependently on the current position of e.g. the lift arm or an operation mode of the working machine, which will be described further below in relation to the description of the second aspect.

According to an example embodiment, the working machine may be an autonomously operated working machine. The working machine is preferably an autonomously operated loader vehicle.

The autonomously controlled working machine may be controlled by the above described control unit. It may also be controlled remotely by an operator.

According to a second aspect, there is provided a method for controlling a working machine, the working machine comprising a frame structure comprising a front frame structure connected to a front rotational axis of the working machine, a rear frame structure connected to a rear rotational axis of the working machine, wherein the front and rear frame structures are connected to each other at pivot joint allowing a mutual rotation around a laterally extending pivot axis, the working machine further comprising a lift arm comprising an inner end portion pivotably connected to the front frame portion at a position between the front and rear rotational axes, and an outer end portion connected to an implement at a position in front of the front rotational axis as seen in the longitudinal direction of the working machine, the method comprising the steps of determining that the working machine is entering a pile of material for loading of the implement; controlling the implement to be arranged in a vertically lower end position; moving the inner end portion of the lift arm from a first position to a second, vertically higher position by controlling a rotation around the laterally extending pivot axis; determining that the implement has entered the pile of material; moving the inner end portion of the lift arm from the second position towards the first position; and moving the implement from the vertically lower end position towards a vertical upper end position.

As described above in relation to the first aspect, when positioning the inner end portion of the lift arm in the second position, the implement will be even further lowered. The advantage is thus that the implement can enter the pile of material at a position closer to the ground, whereby filling of material into the implement will be improved.

The step of determining that the working machine enters the pile of material may be determined by e.g. a control function or control means. Such control means may e.g. be a camera, GPS, LIDAR, etc. Other alternatives are also conceivable, such as a control function determining that the implement is empty and arranged at a relatively low position close to the ground. A load sensor may be used for determining that the implement is empty. A speed sensor may also be used, whereby it can be determined that the working machine enters the pile of material based on a detected speed or deceleration level of the working machine.

Moreover, the working machine may determine to have entered the pile of material by means of e.g. a load sensor determining that the implement is exposed to an increased load, or that an increased propulsive power is needed for operating the working machine forwards. Other alternatives are also conceivable such as e.g. a camera or distance sensor keeping track of the distance between the implement and the pile of material.

According to an example embodiment, the method may further comprise the steps of determining if the working machine is leaving the pile of material; and moving the inner end portion of the lift arm to the first position if the working machine is leaving the pile of material.

Hereby, the movement of the implement towards the vertical upper end position will be made longitudinally closer the front wheels in comparison to lifting the implement when the inner end portion of the lift arm in the second position.

According to an example embodiment, the method may further comprise the steps of determining if the working machine is approaching an unloading station; moving the inner end portion of the lift arm to the second position; and releasing the material at the unloading station when the working machine arrives at the unloading station.

Raising the inner end portion of the lift arm when the outer end portion is arranged a distance above ground will arrange the outer end portion at an increased longitudinal distance from the front wheels. Hereby, the outer end portion of the lift arm will increase its coverage for being able to properly reach the unloading station. The unloading station may e.g. be a loading platform of a truck, etc.

According to an example embodiment, the working machine may comprise a counterweight arrangement connected to the front frame portion, the counterweight arrangement being movable between an inner and an outer portion of the front frame portion, wherein the inner portion is located in front of the outer portion as seen in the longitudinal direction of the working machine.

According to an example embodiment, the method may further comprise the step of positioning the counterweight arrangement at the inner portion when moving the inner end portion of the lift arm to the first position and operating the working machine with an empty implement.

An advantage is that the front wheels will be exposed to an increased pressure which will improve the grip between the front wheels and the ground.

According to an example embodiment, the method may further comprise the step of positioning the counterweight arrangement at the outer portion before releasing the material at the unloading station. Hereby, improved stability is achieved when unloading having the implement at a relatively high vertical position above ground.

Further effects and features of the second aspect are largely analogous to those described above in relation to the description of the first aspect.

Further features of, and advantages with, the present invention will become apparent when studying the appended claims and the following description. The skilled person will realize that different features of the present invention may be combined to create embodiments other than those described in the following, without departing from the scope of the present invention.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
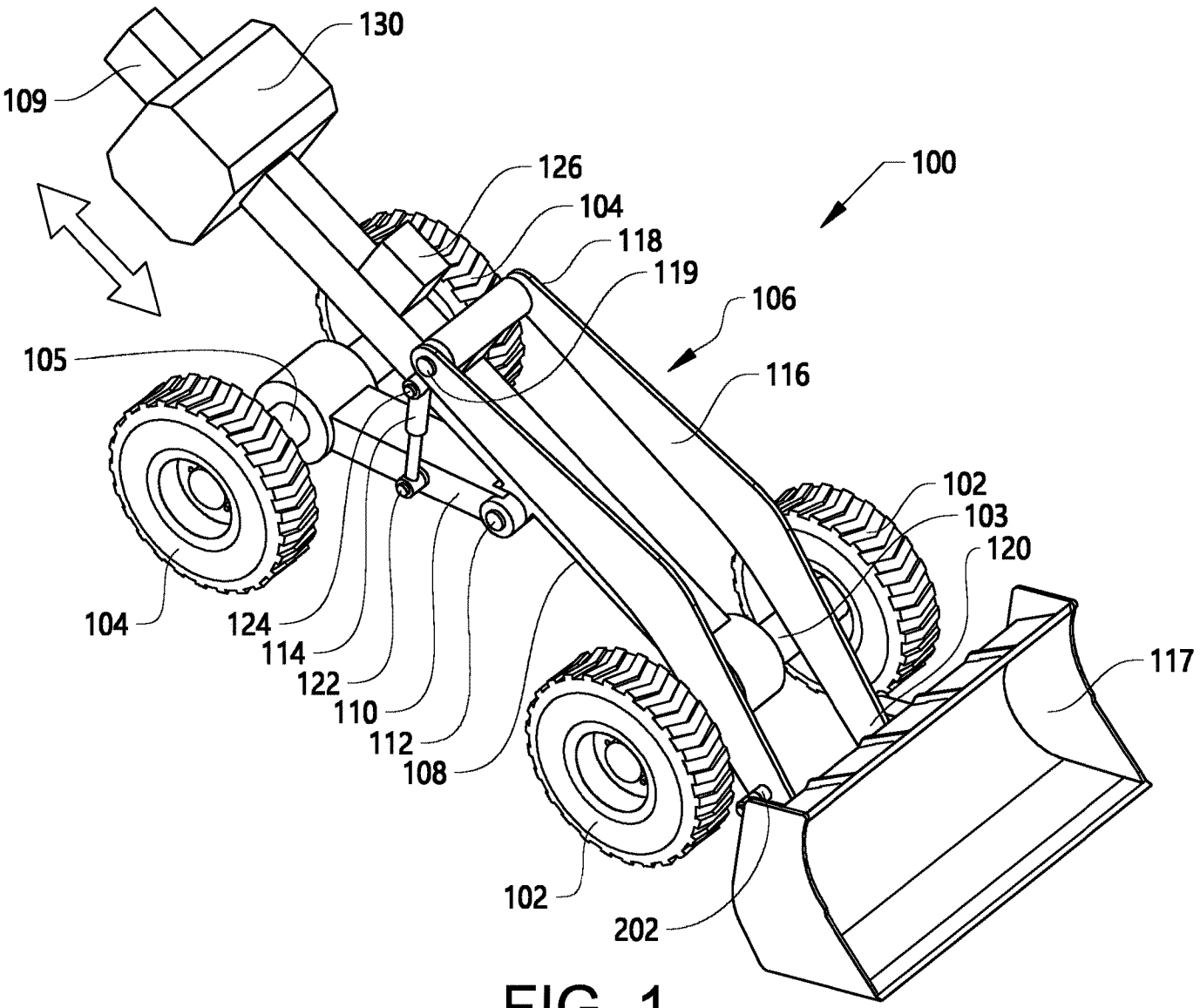
FIG. 1 is a perspective view schematically illustrating a working machine according to an example embodiment.

The present invention will now be described more fully hereinafter with reference to the accompanying drawings, in which exemplary embodiments of the invention are shown. The invention may, however, be embodied in many different forms and should not be construed as limited to the embodiments set forth herein; rather, these embodiments are provided for thoroughness and completeness. Like reference character refer to like elements throughout the description.

With particular reference to FIG. 1, which is a perspective view schematically illustrating a working machine 100 according to an example embodiment. The working machine 100 comprises a pair of front wheels 102 and a pair of rear wheels 104. The front wheels 102 are connected to a front rotational axis 103 and the rear wheels 104 are connected to a rear rotational axis 105. The front and rear rotational axes are in FIG. 1 depicted as a respective front and rear wheel axle. However, the working machine may be operated by wheel hub motors, and in such a case no physical wheel axles may be present. The working machine can thus be operated by wheel hub motors or by other types of prime movers, such as an ICE, an electric machine, etc. Steering of the working machine may, for example, be controlled by so-called Ackermann steering, either on both of the front 102 and rear 104 wheels, or solely on the rear wheels 104.

The working machine 100 further comprises a frame structure 106 supporting various components, etc. In detail, the frame structure 106 comprises a front frame portion 108 and a rear frame portion 110. The front 108 and rear 110 frame portions are pivotally connected to each other at a pivot joint 112. Thus, the pivot joint 112 allows a mutual rotation between the front 108 and rear 110 frame portions. Moreover, the front frame portion 108 is pivotably connected to the front rotational axis 103 and the rear frame portion 110 is pivotably connected to the rear rotational axis 105. As can be seen in FIG. 1, the front frame portion 108 extends from the front rotational axis 103 and in a direction rearward of the working machine 100. In the example depicted in FIG. 1, the front frame portion 108 extends from the front rotational axis 103 to a rear end 109 located rearwards of the pivot joint 112. In the example of FIG. 1, the rear end 109 is located at a longitudinal position rearward of the rear rotational axis 105.

Moreover, the working machine 100 comprises a lift arm 116 connected to an implement 117 at an outer end portion 120 of the lift arm 116. The lift arm 116 is pivotably connected to the front frame portion 108 of the frame structure at an inner end portion 118 of the lift arm 116. In detail, the lift arm 116 is connected to the front frame portion 108 at a lift arm pivot joint 119. The lift arm pivot joint 119 is preferably arranged at a longitudinal position between the front 103 and rear 105 rotational axes. The lift arm 116 is thus raised and lowered by a pivotal motion at the lift arm pivot joint 119. This motion is preferably achieved by using a lift cylinder (not shown). The lift motion of the lift arm is illustrated in further detail in FIGS. 2 and 3, and also described below. The implement 117, which in FIG. 1 is exemplified in the form of a bucket, can also be tilted in relation to the lift arm, preferably by using a tilt cylinder 202.

As is further depicted in FIG. 1, the working machine 100 comprises an actuator arrangement 114. The actuator arrangement 114, in FIG. 1 exemplified as a hydraulic cylinder, is arranged to provide a mutual motion between the front frame portion 108 and the rear frame portion 110. The actuator arrangement 114 is, as depicted in FIG. 1, preferably connected between a portion 122 of the rear frame portion 110 and a portion 124 of the front frame 108. The portion 124 of the front frame 108 is thus arranged above the rear frame portion 110. Hereby, when the actuator arrangement 114 is extended, the portion 124 of the front frame 108 is raised in relation to the rear frame structure 110, i.e. the front 108 and rear 110 frame portions move away from each other. When, on the other hand, the actuator arrangement 114 is retracted, the portion 124 of the front frame 108 is lowered in relation to the rear frame structure 110, i.e. the front 108 and rear 110 frame portions move closer to each other. As the lift arm pivot joint 119 is arranged on the front frame portion 108 at a location longitudinally rearward of the pivot joint 112, the inner end portion 118 of the lift arm 116 will be raised when extending the actuator arrangement 114.

Furthermore, the working machine 100 also comprises a control unit 126 which is connected to various parts of the working machine 100. The control unit 126 is particularly arranged to control the motion of the actuator arrangement 114. The control unit 126 may also be arranged to control lifting and lowering of the lift arm, tilting of the implement, as well as driving operation of the working machine 100. The working machine 100 is thus preferably an autonomously operated working machine 100. The autonomously operated working machine may be controlled by operation of the control unit, or remotely controlled whereby the control unit receives control signals for driving the working machine in various directions.

Moreover, the working machine 100 comprises a counterweight 130 connected to the front frame portion 108 at a position rearward of the pivot joint 112. The counterweight 130 is movable along a portion of the front frame portion 108 in order to controllably compensate for different load conditions. Different examples of operation of the counterweight will be given below.

Figure 2:
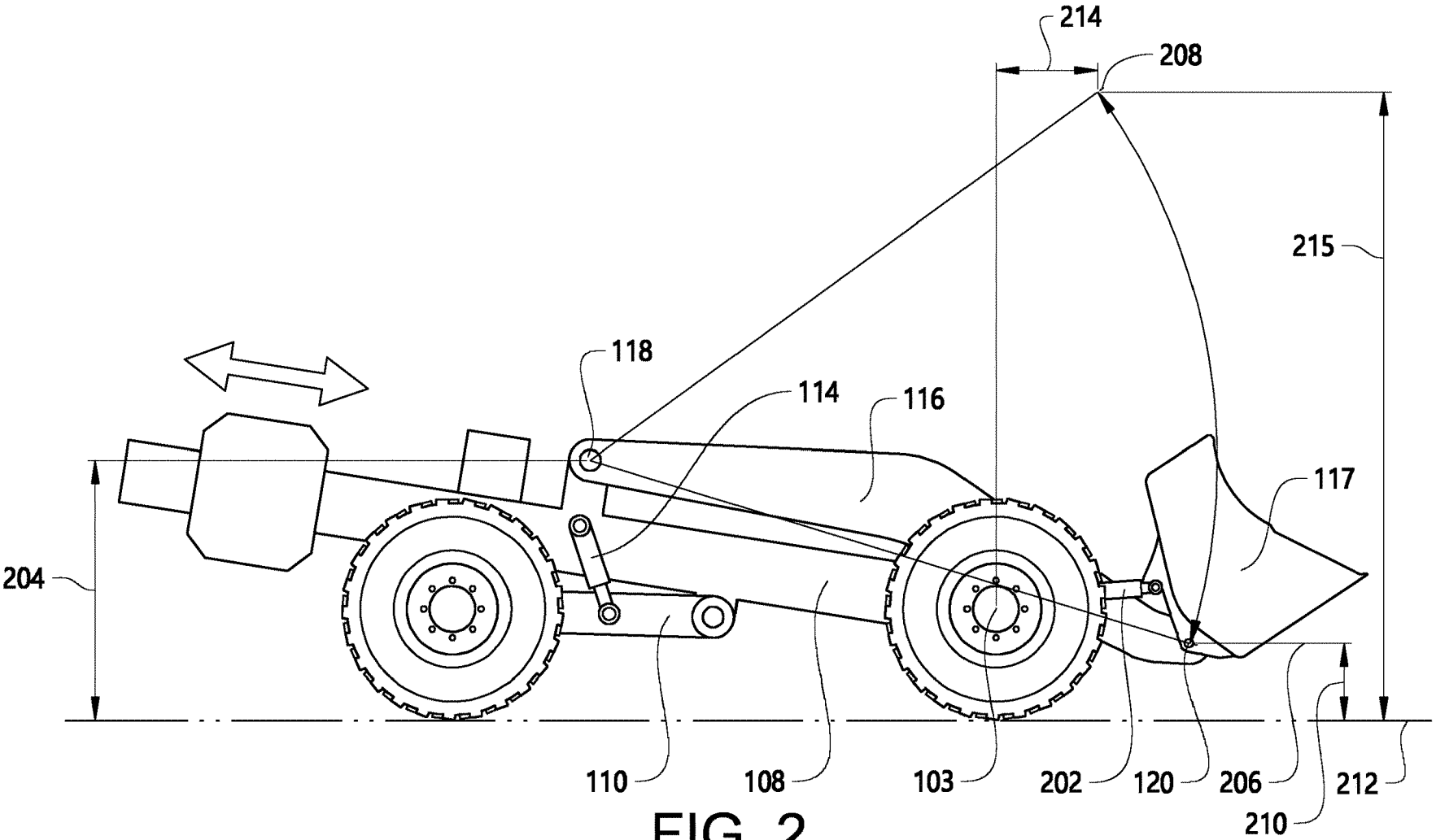
FIG. 2 is a side view of the working machine in FIG. 1 when arranging the front and rear frame portions close to each other; according to an example embodiment
Figure 3:
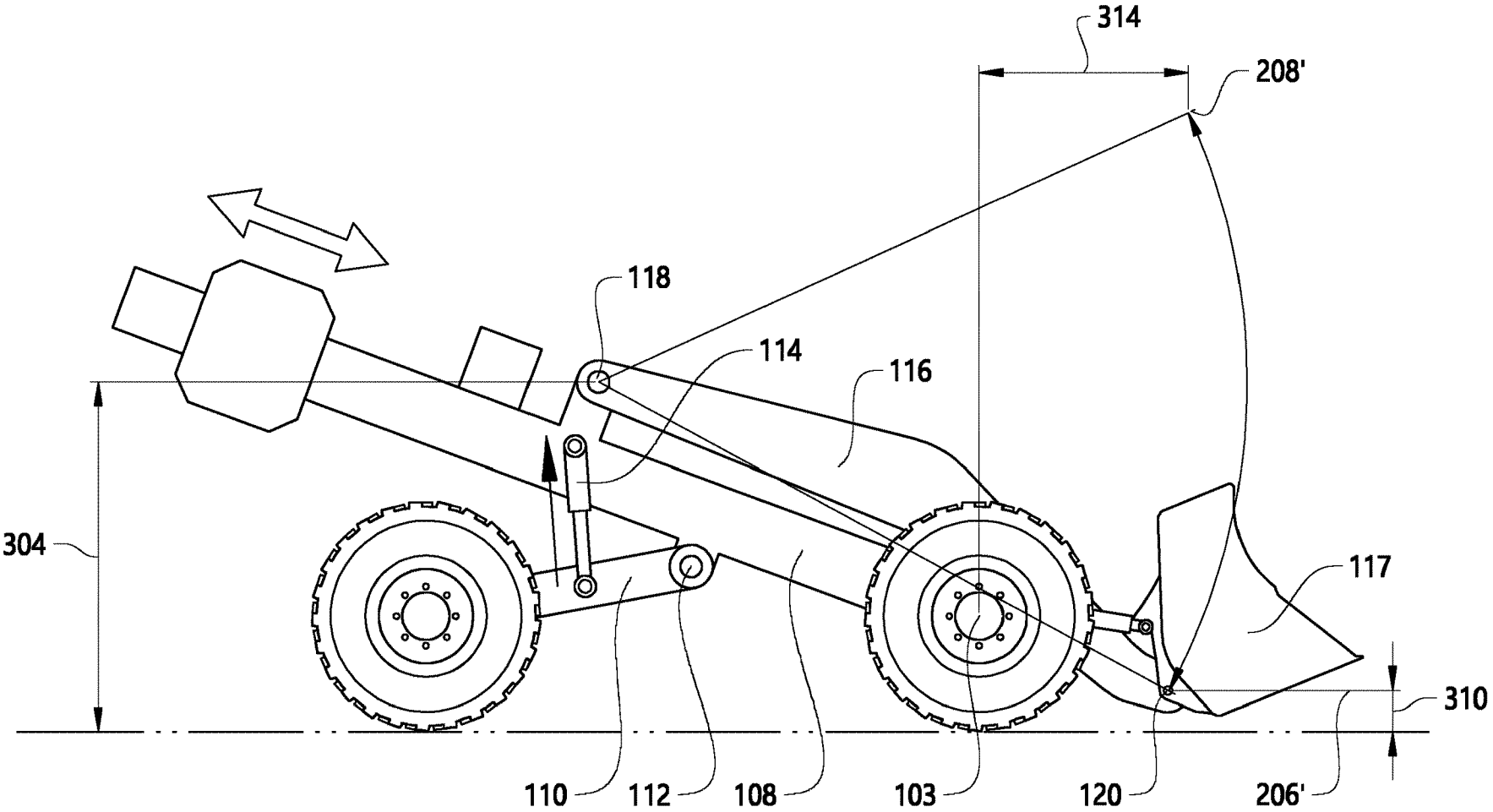
FIG. 3 is a side view of the working machine FIG. 1 when the front and rear frame portions are displaced from each other; according to an example embodiment.
Figure 4:
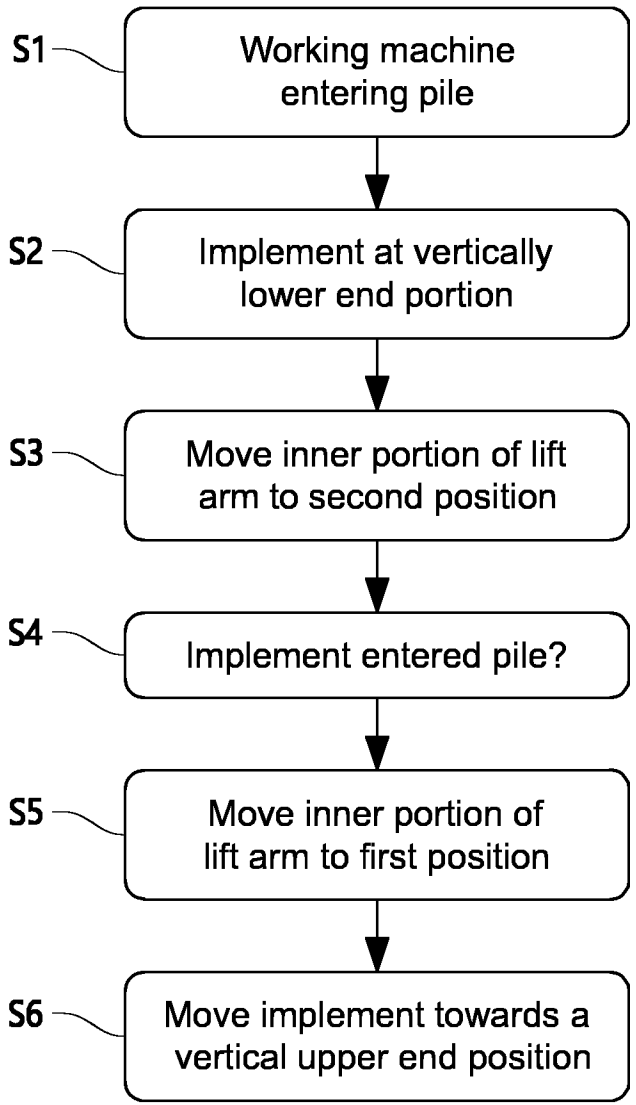
FIG. 4 is a flow chart illustrating a method for controlling the working machine according to an example embodiment.

In order to describe the functionality of the working machine in FIG. 1, reference is made to FIGS. 2-4. With initial reference to FIG. 2, which is a side view of the working machine in FIG. 1 when arranging the front 108 and rear 110 frame portions close to each other. In detail, the actuator arrangement 114 is arranged in a fully retracted position. Hereby, the inner end portion 118 of the lift arm 116 is arranged at a first, lower position 204 above ground level. As also depicted in FIG. 2, the outer end portion 120 of the lift arm 116 is controllable between a vertical lower end position 206 and vertical upper end position 208 by means of the pivotal motion at the inner end portion 118. When the outer end portion 120 is arranged at the vertical lower end position 206, the outer end portion 120 is arranged at a vertical distance 210 from ground level 212, and when the outer end portion 120 is arranged at the vertical upper end position 208, the outer end portion 120 is arranged at a higher vertical distance 215 from the ground level 212. Furthermore, when the outer end portion 120 is arranged at the vertical upper end position 208, the outer end portion 120 is arranged at a first longitudinal distance 214 from the front rotational axis 103.

Reference is now made to FIG. 3 which is a side view of the working machine FIG. 1 when the front and rear frame portions are displaced from each other. As can be seen, the front 108 and rear 110 frame portions are moved in relation to each other in comparison to the relative position depicted in FIG. 2. In detail, the actuator arrangement 114 is extended in relation to the illustration in FIG. 2. Hereby, the front 108 and rear 110 frame portions rotate relative to each other around the pivot joint 112. The front 103 and rear 105 rotational axes are thus moved towards each other. The inner end portion 118 of the lift arm 116 is hereby raised to a second, vertically higher position 304 above ground level. Thus, the second position 304 is higher above ground level compared to the first position 204. Moreover, the outer end portion 120 of the lift arm 116 is maintained in the lower end position 206.

When rotating the front 108 and rear 110 frame portions relative to each other, the front frame portion 108 also rotates around the front rotational axis 103. As the inner end portion 118 of the lift arm 116 is connected to the front frame portion 108 a distance behind the front rotational axis 103, the lift arm 116 will rotate around the front rotational axis 103 when raising the inner end portion to the second position 304. Hereby, the outer end portion 120 of the lift arm is arranged at a vertical lower end position 206' which is located closer to ground level in comparison to the position depicted in FIG. 2. In detail, the outer end portion 120 of the lift arm is located at a lower vertical distance 310 from ground level in comparison to the vertical distance 210 from ground level depicted in FIG. 2. When e.g. entering a pile of soil, the implement 117 is able to dig further into the pile.

When raising the lift arm 116 while keeping the inner end portion 118 of the lift arm 116 in the second, vertically higher position, the outer end portion 120 of the lift arm 116 will be arranged at a vertical upper end position 208' located at a second longitudinal distance 314 from the front rotational axis 103. The second longitudinal distance 314 is larger than the first longitudinal distance 214.

Based on the above description, it may thus be beneficial to arrange the inner end portion 118 of the lift arm 116 in the second, vertically higher position 304 when entering a material to be dug from the ground. It may thereafter be beneficial to lower the inner end portion 118 to the first position 204 depicted in FIG. 2, for providing the implement 117 closer to the front rotational axis 103 during lifting of the implement 117. Also, when moving the inner end portion 118 from the second position to the first position, the implement will be raised which is beneficial as the need of raising the implement using e.g. hydraulics is not needed.

Reference is therefore made to FIG. 4 is a flow chart illustrating a method for controlling the working machine according to an example embodiment. Firstly, after initiating operation, it is determined S1 that the working machine 100 is entering a pile of material for loading the implement. This can be determined in a number of different manners, such as by sensors or cameras, etc. It may also be determined by solely detecting that the working machine is moving with an empty implement 117. It can hereby be assumed that the working machine is on its way to a pile of material for loading. The implement 117 is controlled S2 to be arranged in a vertically lower end position 206. This is achieved by rotation of the inner end portion 118 of the lift arm 116 around the lift arm pivot joint 119. Thereafter, before digging, the inner end portion 118 of the lift arm is moved S3 from the first position 204 depicted in FIG. 2 to the second position 304 depicted in FIG. 3. Hereby, and as described above, the implement will be arranged at lower vertical distance 310 from ground level.

The digging operation can now be initiated and the control unit 126 can determine S4 that the implement 117 has entered the pile of material. This is preferably made by receiving a signal indicating that an increased torque for driving the working machine forwards is necessary. The inner end portion 118 of the lift arm 116 is thereafter moved S5 to the first position 204 as is depicted in FIG. 2, whereby the implement 117 is moved S6 vertical upper end position 208. The inner end portion 118 is preferably moved to the first position 204 when it is determined that the working machine is leaving the pile of material, i.e. when the digging operation is completed.

The working machine 100 is thereafter typically driven towards an unloading station for unloading the material in the implement. When arriving at the unloading station, the inner end portion 118 can preferably be arranged at the second position depicted in FIG. 3. Hereby, the implement is arranged at the second longitudinal distance 314 from the front rotational axis 103 when arranged at the upper end position 208'. The implement 117 can hereby reach further away from the front wheels 102.

Preferably, when operating the working machine 100 with an empty implement, the counterweight is positioned at an inner end portion of the front frame portion 108. When on the other releasing material at the unloading station, the counterweight should preferably be positioned at an outer end position of the front frame portion 108.

It is to be understood that the present invention is not limited to the embodiments described above and illustrated in the drawings; rather, the skilled person will recognize that many changes and modifications may be made within the scope of the appended claims.

The invention claimed is:

1. A working machine, comprising a pair of front wheels having a front rotational axis, a pair of rear wheels having a rear rotational axis, a frame structure comprising a front frame portion connected to the front rotational axis, a rear frame portion connected to the rear rotational axis, and a pivot joint pivotally connecting the front and rear frame portions to each other around a laterally extending pivot axis, an actuator arrangement connected to the frame structure between the front frame portion and the rear frame portion, the actuator arrangement being arranged to control a mutual motion between the front frame portion and the rear frame portion; and a lift arm comprising an inner end portion pivotably connected to the front frame portion at a position between the front and rear wheels, and an outer end portion connectable to an implement at a position in front of the pair of front wheels as seen in the longitudinal direction of the working machine, wherein the actuator arrangement is arranged to control the inner end portion of the lift arm between a first position and a second, vertically higher position when moving the front and the rear frame portions relative to each other, and wherein the front rotational axis and rear rotational axis move toward each other by a rotation of the pivot joint when moving the inner end portion of the lift arm between the first and second positions.

2. The working machine according to claim 1, wherein the outer end portion of the lift arm is controllable between a vertical upper end position and a vertical lower end position by a pivotal motion of the inner end portion of the lift arm, the vertical lower end position being provided at a lower vertical distance from ground level when the inner end portion assumes the second position compared to when the inner end portion assumes the first position.

3. The working machine according to claim 1, wherein the front frame portion is pivotably connected to the front rotational axis and the rear frame portion is pivotably connected to the rear rotational axis.

4. The working machine according to claim 1, wherein the actuator arrangement is an actuator cylinder arranged move at least portions of the front and rear frame portions away from each other when moving the inner end portion of the lift arm from the first position to the second position.

5. The working machine according to claim 1, wherein at least a portion of the front frame portion is arranged vertically above at least a portion of the rear frame portion.

6. The working machine according to claim 5, wherein the actuator arrangement is connected between the portion of the front frame portion and the portion of the rear frame portion.

7. A working machine, comprising a pair of front wheels having a front rotational axis, a pair of rear wheels having a rear rotational axis, a frame structure comprising a front frame portion connected to the front rotational axis, a rear frame portion connected to the rear rotational axis, and a pivot joint pivotally connecting the front and rear frame portions to each other around a laterally extending pivot axis, an actuator arrangement connected to the frame structure between the front frame portion and the rear frame portion, the actuator arrangement being arranged to control a mutual motion between the front frame portion and the rear frame portion;

a lift arm comprising an inner end portion pivotably connected to the front frame portion at a position between the front and rear wheels, and an outer end portion connectable to an implement at a position in front of the pair of front wheels as seen in the longitudinal direction of the working machine; and a counterweight arrangement connected to the front frame portion wherein the front frame portion extends from the front rotational axis and in a direction rearwards of the front rotational axis, the counterweight being movable along at least a portion of the extension of the front frame portion.

8. The working machine according to claim 1, wherein the working machine is an autonomously operated working machine.

9. A method for controlling a working machine, the working machine comprising a frame structure comprising a front frame structure connected to a front rotational axis of the working machine, a rear frame structure connected to a rear rotational axis of the working machine, wherein the front and rear frame structures are connected to each other at pivot joint allowing a mutual rotation around a laterally extending pivot axis, the working machine further comprising a lift arm comprising an inner end portion pivotably connected to the front frame portion at a position between the front and rear rotational axes, and an outer end portion connected to an implement at a position in front of the front rotational axis as seen in the longitudinal direction of the working machine, the method comprising the steps of:

determining that the working machine is entering a pile of material for loading of the implement;

controlling the implement to be arranged in a vertically lower end position;

moving the inner end portion of the lift arm from a first position to a second, vertically higher position by controlling a rotation around the laterally extending pivot axis;

determining that the implement has entered the pile of material;

moving the inner end portion of the lift arm from the second position towards the first position; and moving the implement from the vertically lower end position towards a vertical upper end position.

10. The method according to claim 9, further comprising the steps of:

determining if the working machine is leaving the pile of material; and moving the inner end portion of the lift arm to the first position when the working machine is leaving the pile of material.

11. The method according to claim 9, further comprising the steps of:

determining if the working machine is approaching an unloading station;

moving the inner end portion of the lift arm to the second position; and releasing the material at the unloading station when the working machine arrives at the unloading station.

12. The method according to claim 9, wherein the working machine comprises a counterweight arrangement connected to the front frame portion, the counterweight arrangement being movable between an inner and an outer portion of the front frame portion, wherein the inner portion is located in front of the outer portion as seen in the longitudinal direction of the working machine.

13. The method according to claim 12, further comprising the step of:

positioning the counterweight arrangement at the inner portion when moving the inner end portion of the lift arm to the first position and operating the working machine with an empty implement.

14. The method according to claim 11, further comprising the step of:

positioning the counterweight arrangement at the outer portion before releasing the material at the unloading station.

* * * * *